United States Patent [19]

Cowper

[11] Patent Number: 4,991,997

[45] Date of Patent: Feb. 12, 1991

[54] METHOD AND APPARATUS FOR THE TRANSPORT OF PARTICULATE SOLIDS USING A SUBMERGED FLUID INDUCTION DEVICE

[76] Inventor: Norman T. Cowper, 1A Noonbinna Crescent, Northbridge, New South Wales, Australia

[21] Appl. No.: 352,122

[22] Filed: May 15, 1989

[30] Foreign Application Priority Data

May 13, 1988 [AU] Australia ..... PI8216

[51] Int. Cl.[5] ..... E02F 3/88

[52] U.S. Cl. ..... 405/73; 405/74; 37/63; 37/75; 37/78

[58] Field of Search ..... 405/73, 74, 163, 164, 405/226, 248; 37/58, 59, 61–63, 75, 78

[56] References Cited

U.S. PATENT DOCUMENTS

| | | | |
|---|---|---|---|
| 543,637 | 7/1895 | Bates | 37/63 |
| 661,609 | 11/1900 | Hoover et al. | 37/63 X |
| 2,678,203 | 5/1954 | Huff | 37/78 X |
| 3,585,740 | 6/1971 | Dekoning | 37/63 |
| 3,638,432 | 2/1972 | Schoonmaker | 405/74 |
| 3,674,100 | 7/1972 | Becker | 37/63 X |
| 3,695,049 | 10/1972 | Steveninck | 37/63 X |
| 4,123,858 | 11/1978 | Batchelder | 37/63 X |
| 4,470,208 | 9/1984 | Van Berk et al. | 37/63 |
| 4,574,501 | 3/1986 | Sloan | 405/74 X |

OTHER PUBLICATIONS

"Fluidization–A New Channel Maintenance Technology Now Available"; Adams, Parks, Weismann and Collins; 1986.

"Anna Maria, Florida: Case Study of Sand Fluidization for Channel Maintenance"; Collins, Parks, Weisman and Adams; 1987.

"Fluidization Applied to Sediment Transport as an Alternative to Maintenance Dredging of Navigation Channels in Tidal Inlets"; Parks, Weisman and Collins; 1983.

"Maintaining Tidal Inlet Channels by Fluidization"; Weisman, Collins & Parks; Nov. 1982.

"Analytical Model of Duct Flow Fluidization"; Bailard and Inman; 1975.

*Primary Examiner*—Dennis L. Taylor
*Assistant Examiner*—Franco S. DeLiguori
*Attorney, Agent, or Firm*—Edmund J. Wasp

[57] ABSTRACT

A method and apparatus for the transport of sand or silt underlying or adjoining a body of water using a submerged fluid induction device is disclosed. The device includes an open bottom and comprises an enclosure which is submerged below the top surface of the sand. One or more apertured pipes, supplied with a pressurized fluidizing medium such as seawater, are positioned below the enclosure. The apertured pipe(s) fluidize the sand underlying the enclosure to induce it up into the enclosure and out an opening at one end of the enclosure. A sump enclosure receives the fluidized sand discharged from the enclosure, and a jet pump within the sump enclosure, having its own associated fluidizing pipe, pumps the fluidized sand through a transport pipe to a remote discharge point. The device as described prevents the build up of sand in the region overlying the enclosure.

17 Claims, 4 Drawing Sheets

METHOD AND APPARATUS FOR THE TRANSPORT OF PARTICULATE SOLIDS USING A SUBMERGED FLUID INDUCTION DEVICE

This invention relates to the transport of particulate solids and more particularly to an improved submerged fluid induction device for the transport of particulate solids. The invention is useful for the maintenance of beaches and navigation channels.

Traditionally, the maintenance of navigation channels has been carried out by dredging. Dredging is a costly exercise, the major cost item being incurred each time the dredger is brought to the site, and because of this expense dredging is usually only carried out every few years. Between dredgings, the navigation channel "silts up" and generally deteriorates badly. In addition to dredging, training walls must be built, at high costs, to attempt to maintain the navigability.

It has been proposed to apply fluidization techniques for the control of sand bars which build up for example on ocean beachfronts, and for maintenance of navigation channels, particularly in the case of narrow channels where dredging is not suitable. While compacted sand on the floor of a tidal inlet behaves normally—that is to say, as a solid—it can be fluidized by burying a perforated pipe beneath the surface of the sand bed and pumping seawater through the pipe and out via the perforations.

If a sufficient quantity of water travels upwardly to the surface of the sand bed, the resulting slurry of sand and water will behave as a fluid. In its fluidized state, sand will flow by gravity down a gentle slope, or it can be moved by water currents. Where the fluidized sand or silt above the pipe is moved away, the walls of the resulting channel will slump, become fluidized and in turn be transported away. The channel walls can eventually reach their so-called "angle of repose", to create a satisfactory and usable channel depending on the directions of the water currents.

The problem with this prior approach however is that it is too dependent on the direction of the water currents above the pipe. For this prior method to achieve satisfactory results, the currents must be flowing in the direction of desired sand travel.

It is therefore an objective of the present inventor to provide a submerged sand fluidizing and transport device which does not depend on current flows to transport sand to a desired location.

This objective is met in the present invention by the provision of a submerged fluid induction device for the transporation of particulate solids, comprising an inverted flume, which in the presently preferred embodiment has a solid top and side walls, one end being partially closed and the other being closed by an end-wall, and at least one apertured fluidizing pipe disposed below the open bottom of the flume. This fluid induction device is adapted to be buried, substantially horizontally, in the sand or silt which underlies or adjoins a body of water. When water is impelled through the fluidizing pipe(s) and discharged through the apertures of the pipe, the sand or silt overlying the pipe is induced into the flume in fluidized form for discharge from the partially open end.

The flume may be laid with a small but positive pressure gradient to aid movement of fluidized sand or silt therethrough towards the partially open end.

Alternatively, a fluid flow inducing means, such as a high pressure water jet can be provided at the closed end of the flume to encourage flow towards the partially open end of the flume.

Preferrably a sump pump is provided at the partially open end of the flume to transport sand discharged from the flume to a remote point.

Ideally the apertures of the fluidizing pipe direct the fluidizing medium impelled therethrough downwardly, although they may also be directed upwardly or sideways.

The aspect ratio (width to depth) of the flume cross-section is chosen to suit the flume length and the transport requirements.

In order that the reader may gain a better understanding of the present invention, hereinafter will be described some embodiments thereof, by way of example only and with reference to the accompanying drawings in which:

FIG. 1 is a schematic isometric view of a device according to the present invention;

FIG. 2. is a schematic transverse cross-section;

Figure 1:
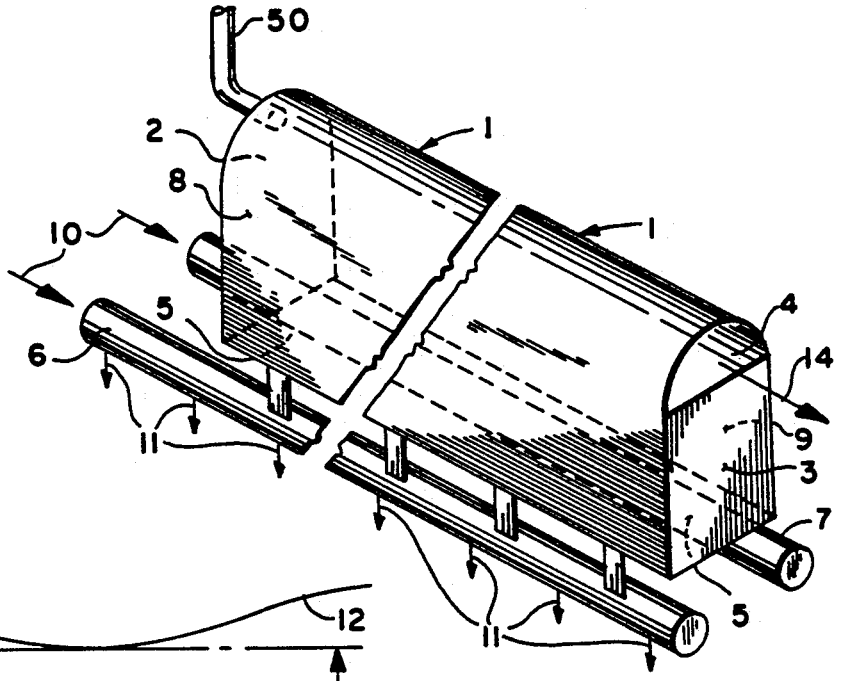

FIG. 1 shows an inventive submerged fluid induction device which comprises a flume 1, ideally a metal member of inverted U-shaped transverse cross-section made from, say, stainless steel or some other rustless metal, or from some other suitable material, such as fiberglass. One end of flume 1 is closed by a solid end-wall 2 while the other end may be partially closed off by a part end-wall 3, leaving a discharge opening 4 for sand or silt. Disposed below the open bottom 5 of flume 1 there are in this embodiment two fluidizing pipes and 6 and 7, one positioned beneath each side-wall 8, 9 of flume 1. Each fluidizing pipe 6, 7 is provided with a plurality of circular apertures (not shown) which direct, preferably downwardly, a fluidizing medium flowing through the pipes. Preferably the fluidizing medium is seawater provided by seawater pumps. Arrows 10 pointing into the pipes 6, 7 indicate the ingress of the fluidizing medium, while arrows 11 indicate the jets of water, in this embodiment flowing downwardly, through the apertures in the fluidizing pipes 6 and 7.

Figure 2:
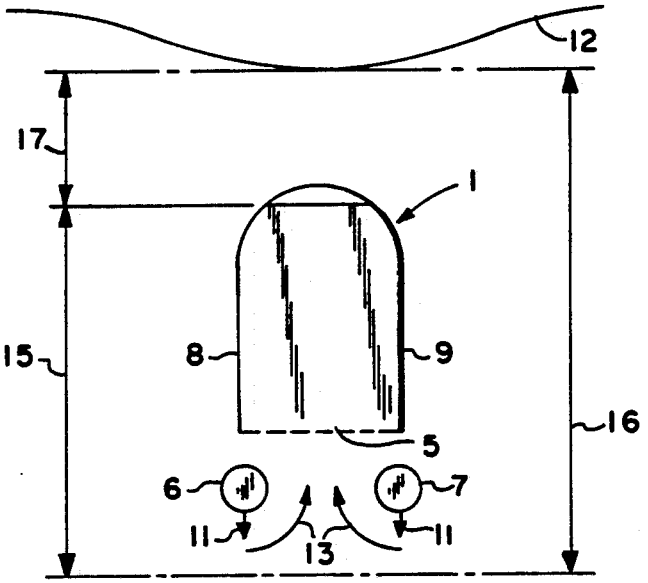

FIG. 2 shows, schematically, a cross-section of the inventive device buried below a sand bed of a navigation channel, the sand bed level is indicated by 12. The depth of burial of the device in the sand may be limited by the level of the strata, or rock shelf, underlying the sand. As shown in FIG. 2, spacing is provided between the bottoms of walls 8, 9 and fluidizing pipes 6 and 7 to allow an unhindered flow path into flume 1 for induced solids—that is to say, the sand and/or silt.

When seawater is impelled through fluidizing pipes 6, 7 and discharged through their apertures, sand and/or silt becomes fluidized by virtue of the flow of water and is induced into flume 1, as indicated by arrows 13.

Fluidized particulate solids are discharged through the partially closed end-wall exit 4, in the direction of arrow 14, due to accumulating pressure within the flume as more fluidized sand or silt enters the device. In some circumstances, the device may require an additional energy input to assist sand or silt to flow through the device and out opening 4. This additional energy input may be provided by the application of pressurized fluid to the upstream end of the device through a pipe 50 for example. Pipe 50 would be supplied a fluidizing medium such as seawater from a suitable pump (not shown).

As particulate solids, fluidized by the flow of the fluidizing medium, are transported in the direction of the arrow 14, the level of the solid, compacted sand bed above the flume will drop. The transported solids are ideally removed to a "sump". A sump pump arrangement (later described) can be provided. Such a sump may be situated close in to the shore so as to enable it to be pumped out to some more suitable site; alternatively, the transported solids may be naturally removed by longshore currents, depending on the availability of reliable current flow at the discharge point.

As sand is discharged through opening 4, the portions of the sand bed adjacent to the flume, which are also fluidized to some extent by pipes 6, 7, collapse into the region below the flume to take the place of the sand which has been induced into the flume. This sand then becomes part of the most intensely fluidized region directly below the flume and is induced into flume 1 through the open bottom 5.

FIG. 2 illustrates the internal and external levels of fluidization, indicated respectively at 15 and 16. The internal level of fluidization 15 extends from below the pipes 6, 7 to the top level of the fluidized sand induced into flume 1. The external level of fluidization 16 extends from below pipes 6, 7 to the top of the sand bed. It is believed that the difference between these two fluidization levels, indicated at 17, sets up a force by which the higher fluidized columns of sand on opposite sides of the flume work together to push, or induce, the sand fluidized below the flume up into the flume 1 and out opening 14.

Figure 3:
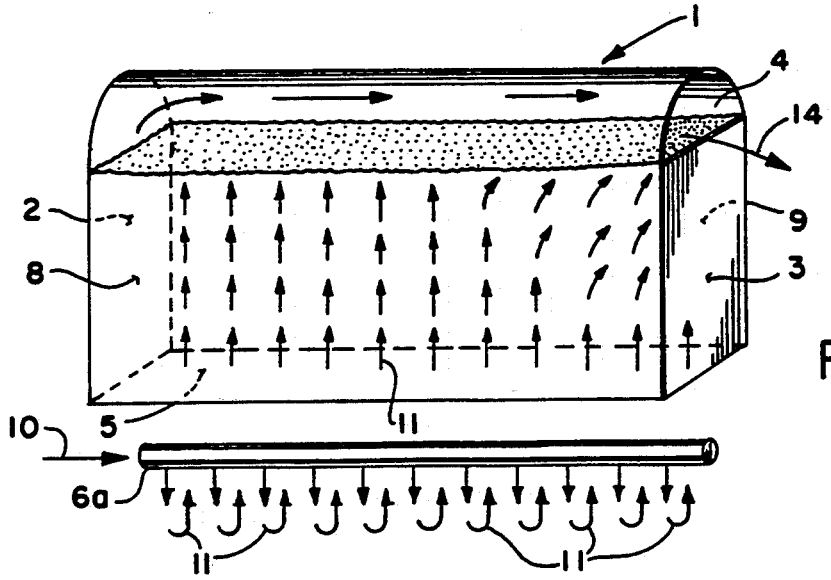
FIG. 3 is a schematic isometric view of a second embodiment.
Figure 4:
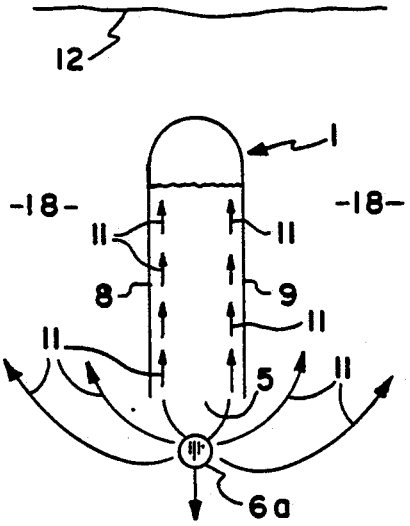
FIG. 4 is a corresponding transverse cross-section to FIG. 3.

FIGS. 3 and 4 show an alternative embodiment having only one centrally-disposed fluidizing pipe 6*a*, with circular apertures (not shown) directed downwardly, upwardly, or sideways. Ideally, apertures will be spaced apart on 50 cm centres and have a diameter of perhaps from 3 to 5 mms. In this embodiment, as indicated in FIG. 4, fluidizing pipe 6*a* is positioned centrally of the side-walls 8, 9 and is provided with a plurality of apertures which direct the fluidizing medium downwardly, upwardly and to the sides, at various angles. Arrows 11 indicate these fluidizing jets. Fluidization of the sand bed again occurs both under flume 1 and on opposite sides of the flume to induce sand fluidized below the flume into the flume.

This is indicated in FIG. 4 by the fluidized sand in the zone 18 on opposite sides of flume 1 which will create pressure to drive fluidized sand into flume 1. Fluidized sand within flume 1 is again transported through flume 1 to be discharged as a fluidized sand stream indicated again by arrow 14. It is believed that this inventive device can be made of a length which is limited only by the fluidizing pressure head available in the zone 18 to induce fluidized sand into the flume.

The fluidized sand discharged at the partially open end of flume 1 may be recovered via a sump pump structure (later described) for transfer by pipeline to a remote location, for example.

Figure 6:
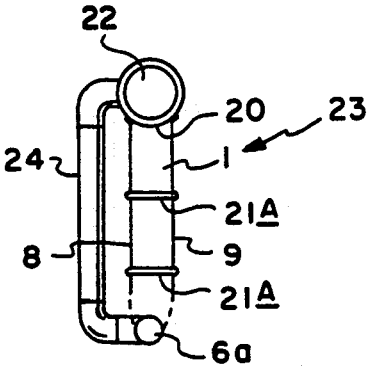
FIG. 6 is a transverse cross-section showing a fluidizing by-pass assembly, associated with the embodiment of FIG. 5.
Figure 5:
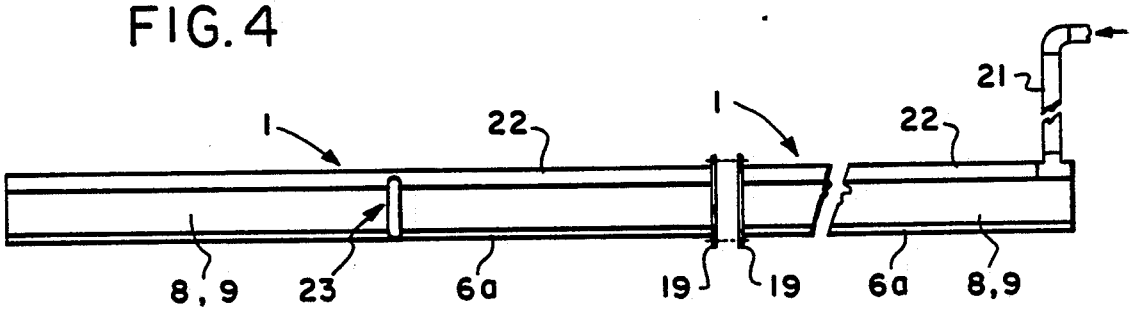
FIG. 5 is a side elevation of a third embodiment.

FIGS. 5 and 6 illustrate a further embodiment which is of importance in certain situations and where the flume is of considerable length.

Here, flume 1 may be manufactured in, say, 10 meter lengths. Each length is joined to an adjacent length by means of flanges 19. In this embodiment, flume 1 has a concave top wall 20 and the usual side walls 8 and 9 which are maintained in correct spaced apart relationship by longitudinally equispaced pins 21*a*. Disposed below flume 1 is the usual fluidizing pipe 6*a* with its plurality of apertures, as in the FIG. 3 and FIG. 4 embodiment.

Pressurized fluidizing fluid enters the device through inlet pipe 21 and is impelled through a header pipe 22 for the purpose of maintaining a sufficiently high pressure all along the device. To this end, at intervals along the flume there are by-pass pipe assemblies 23.

In addition to the previously-mentioned header pipe 22, by-pass pipe assemblies 23 includes a pipe 24 which connects header pipe 22 with fluidizing pipe 6*a*. Pressurized fluid flowing through header pipe 22 is diverted through the by-pass conduits 24 into fluidizing pipe 6*a* to produce the fluidizing jets which act to fluidize the sand or silt.

It is believed that a flowrate of about 3 to 4 liters per second per meter of fluidizing pipe length will generally be required to produce longitudinally continuous and complete fluidization over a zone 400 to 600 mm wide at a burial depth of 200 to 400 mm. The diameter of the fluidizing pipe is determined purely by hydraulic conditions.

It is further believed that for any given sand and aperture conditions, a well-defined relationship will exist between flowrate per unit length of fluidizing pipe and the channel created. Burial depth affects this flowrate per unit length required for initial onset of fluidization. For greater depths of sand a slightly higher flowrate may be necessary, although it is believed that sand depth will have only a minor effect on the flowrate/-width of channel relationship after fluidization has commenced. In as fluidization is allowed to continue over time or as flow rate is increased. this regard, and in the case of uneven sand burial, it is expected that fluidization will commence first in regions of shallow sand coverage and will progress to the normal final state of longitudinally continuous, full fluidization as fluidization is allowed to continue over time, or as flow rate is increased.

Having described alternate embodiments of the submerged fluidizing device for fluidizing the sand in a sand bed, and inducing it into a flume, and for transporting the fluidized sand to the open end of the flume, a sump pump structure for transporting fluidized sand discharged from the flume to a remote point, will now be described.

Figure 7:
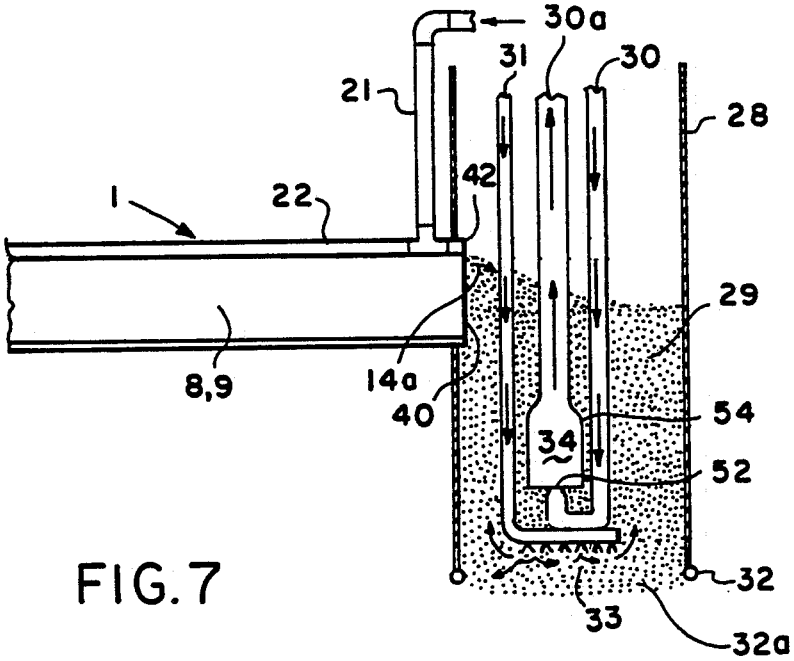
FIG. 7 is a schematic transverse cross-sectional view of a sump pump structure installed at the open end of the flume of FIGS. 5 and 6.

FIG. 7 shows a sump pump structure which could be utilized with the embodiment shown in FIGS. 5 and 6, for example. A cylindrical collection sump 28 is positioned at the discharge end of the flume 1 of FIGS. 5 and 6 to receive the sand discharged from the open end 40 of flume 1 in the direction of arrow 14a. In this embodiment, the end 40 of flume 1 is completely open to the sump 28. The sand discharged from flume 1 collects in the sump 28 to form a bed of sand 29. A jet pump assembly 34 pumps the sand from the sump 28 to a remote location. A high pressure seawater pipe 30, supplied by a pump (not shown) delivers high pressure water to jet pump nozzle 52. Jet pump nozzle 52 directs a high pressure water jet up into the inlet throat 54 of a sand transport pipe 30a. A fluidizing water pipe 31, supplied by a sea water pump (not shown) includes nozzles, or apertures (not shown) which spray jets of water down into the sand below the jet pump to fluidize the sand in the vicinity of jet pump throat 54. This fluidized sand is drawn into the throat 54 and down the sand transport pipe 30a by the entraining effect of the high pressure water jet supplied by nozzle 52. A sand and water mixture is thereby transported through the transport pipe 30a to remove sand from sump 28 as it is delivered to the sump 28 through the open end 40 of flume 1.

Having described the submerged sand fluidization and induction device, and a suitable sump pump structure for transport of sand discharged from the device to a remote location, the installation of the flume and sump structure in a sand bed will not be described with reference to FIGS. 8 and 9.

Figure 8:
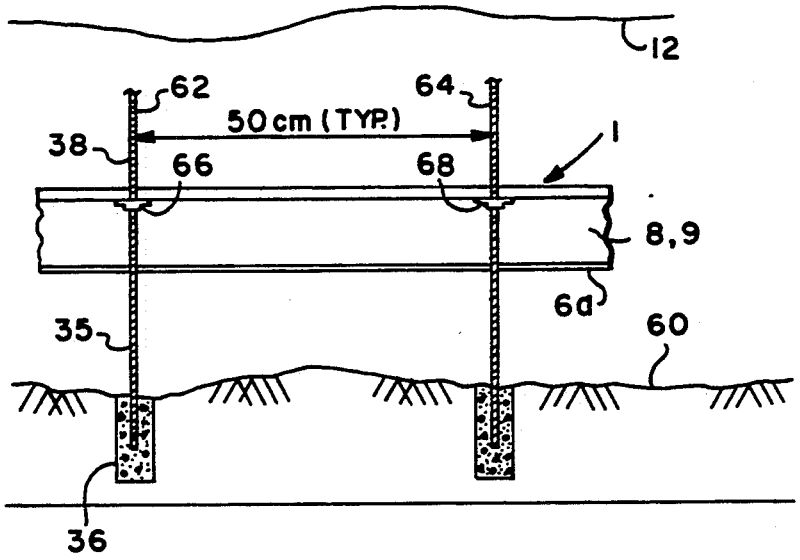
FIG. 8 is a side elevational view of the device of the present invention secured to a rock shelf.

FIG. 8 shows the installation of the device where a rock shelf is available to anchor the device. In this case, cement footings can be installed in the rockshelf which underlies the sand bed and rock bolts secured in the cement footing project upward vertically. The rock bolts and footings would be installed in pairs to stradle the flume 1 at selected equidistant points along the flume 1 depending on its length. Two pairs of rock bolts 62, 64 are shown in FIG. 8. Guide supports 66, 68 in the form of apertured flanges are secured to the sides of the flume 1 and receive the rock bolts 62, 64 therethrough. The flume 1 can now be set up on the sand bed and the seawater pump is turned on to supply seawater to fluidizing pipe 6a. As the pipe 6a fluidizes the sand below the device, the flume 1 begins to sink into the sand. As fluidizing continues, the flume 1 eventually reaches its desired position, at which the guide supports 66, 68 can be fixed in position to the rock bolts 62, 64 threadably by nuts, or by other suitable means.

Figure 9:
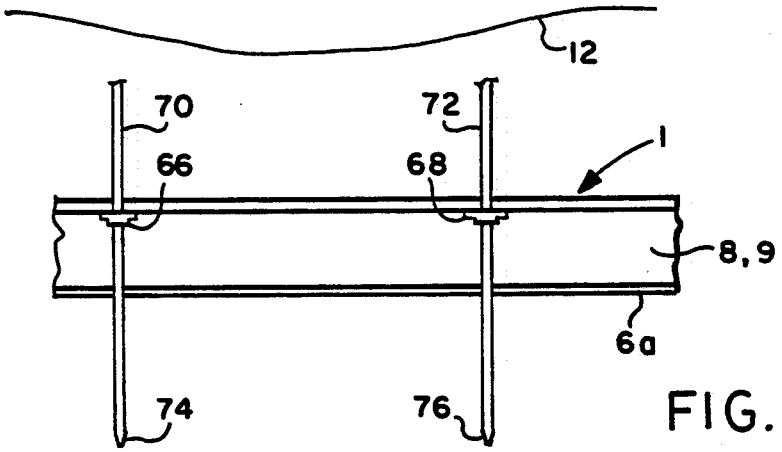
FIG. 9 is a side elevational view of the device of the present invention installed in deep sand.

FIG. 9 shows the installation of the device in deep sand where no rock shelf is available to anchor the flume 1. In this case, hollow pipes 70, 72, having pointed ends 74, 76, take the place of the rock bolts. The pipes 70, 72 are set upon the sand bed and seawater is pumped down the length of the pipes to the pointed ends to fluidize the sand at the bottom of the pipes. As the sand is fluidized, the pipes 70, 72 sink through the sand bed into position. The pipes 70, 72 are burried to a sufficient depth to provide suitable support for the device. The device is otherwise installed in the same way as is described with reference to the FIG. 8 embodiment, with the support guides 66, 68 of flume 1 being secured by suitable means to the pipes 70, 72 once the flume 1 has reached the desired depth within the sand bed.

The sump pump structure shown in FIG. 7 is fluidized into position in a manner which is similar to that used for the flume. Referring back to FIG. 7, sump 28 is open bottomed and includes a fluidizing ring 32 around the periphery of its bottom end. Ring 32 is a circular pipe, or manifold, and it is supplied by high pressure seawater from a suitable pump (not shown). Ring 32 includes circular apertures, or downwardly directed nozzles (not shown), which fluidize the sand below the bottom edge of sump 28 to allow sump 28 to sink into position. Likewise, fluidizing water pipe 31 includes circular apertures or downwardly directed nozzles (not shown) to fluidize the sand below the pipe 31, and the fluidization of this sand, together with the suction and entrainment force provided by the jet pump 34 once it is turned on, allow the jet pump 34 to descend downwardly through the sand bed to the desired position. The jet pump assembly 34, 30, 30a, 31, 52 and 54 can be secured to the sump 28 by any suitable means. The sump 28 in turn is secured to the flume 1 to receive the sand discharged from flume 1 as mentioned above.

Having described the structure, operation and installation of the complete device, one particular application of the device will now be described, as an example of the tremendous utility of the device.

Figure 10:
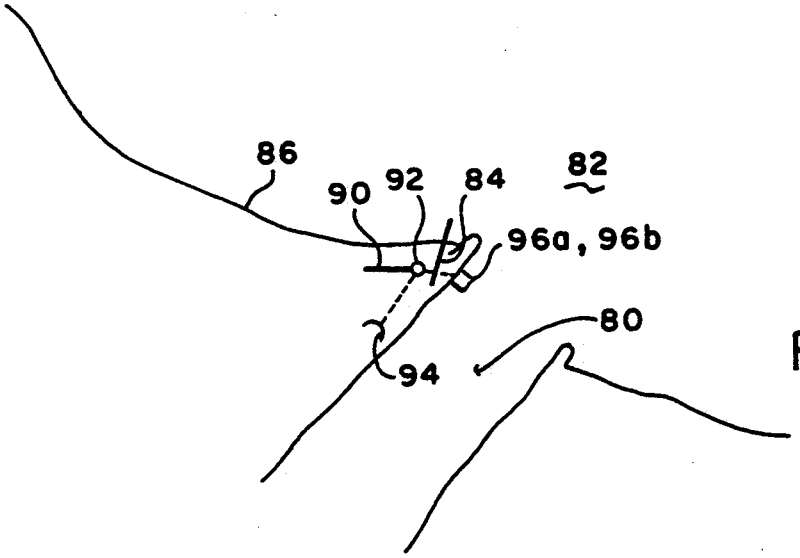
FIG. 10 is a plan view illustrating one application of the invention.

FIG. 10 shows one application of the invention. In this application an inlet 80 to a bay 82 is maintained by a training wall 84. Sand is naturally moved along the beach 86 towards the inlet 80. Without the training wall 84 sand moves from the beach into the inlet eventually creating a sand bar which interfers with the navigability of the inlet 80. The training wall 84 blocks the movement of the sand into the inlet 80. Over time, however, sand builds up on the training wall 84 and will eventually go over or bypass the wall and go into the inlet 80 unless the sand is periodically removed.

To solve this sand accumulation problem, a device 90 made in accordance with FIGS. 5–9 of the present invention could be installed generally parallel to the beachline 86 with the sump pump structure 92 (as in FIG. 7) being positioned at one end of the device 90 as shown. When the sand accumulates to an undesireable extent in front of the training wall 84, the device 90 can be activated to fluidize and transport sand underlying the device into the sump structure 92. Using the jet pump structure 34 of FIG. 7, this sand can then be transported to a discharge point 94 which is located on the other side of a ridge of sand dunes. Seawater pumps 96a and 96b for the device 90 could be located in the inlet 80 as shown in FIG. 10.

Figure 11:
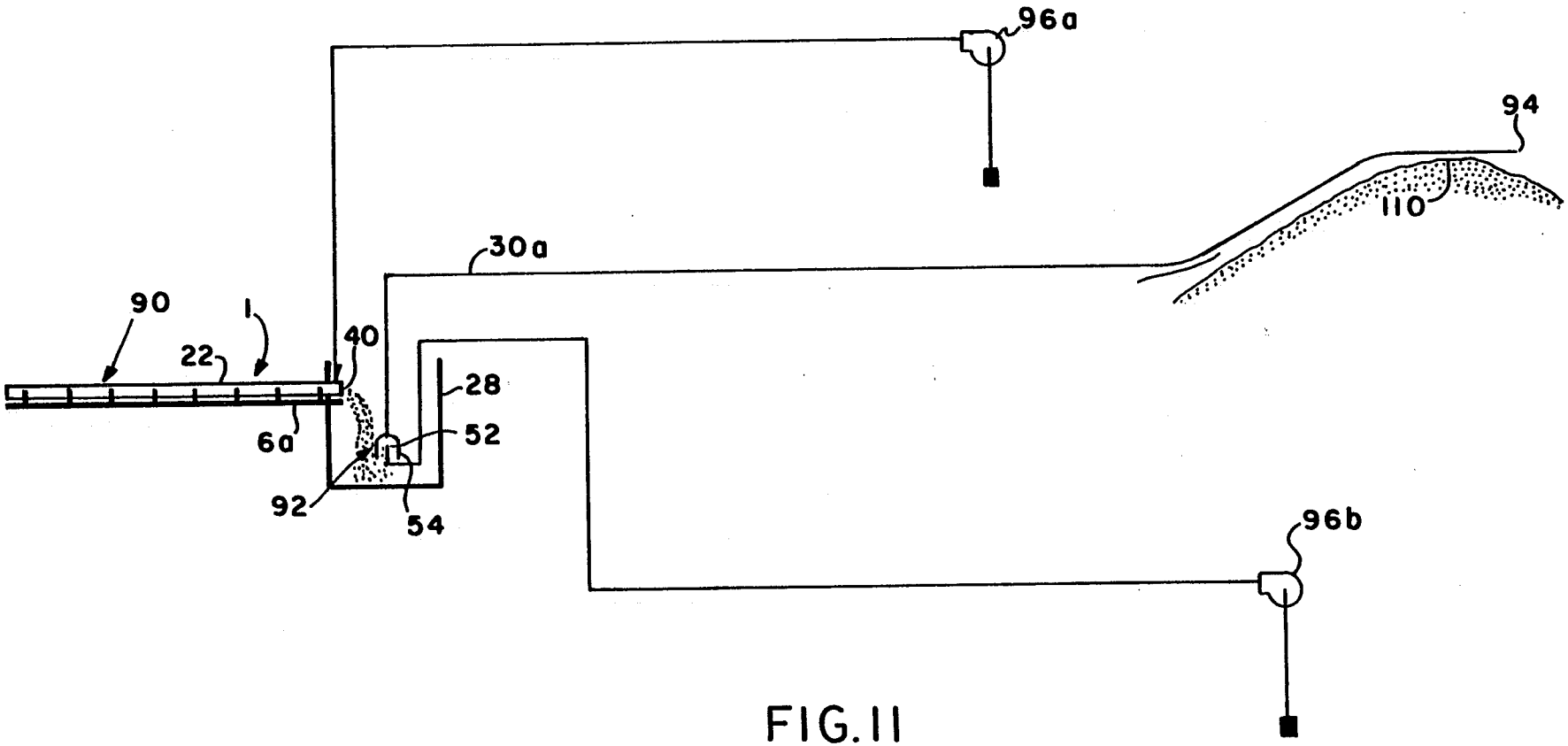
FIG. 11 is schematic view showing more details of the application of the invention illustrated in FIG. 10.

FIG. 11 shows further details of this particular application. As shown, a fluidizing water pump 96a supplies seawater to the header pipe 22 which distributes it to the fluidizing pipe 6a underlying the flume 1. Fluidized sand is discharged out the open end 40 of flume 1 into the sump enclosure 28. Another seawater pump 96b supplies seawater to the jet pump nozzle 52 which discharges it at a high velocity into the jet pump throat 54 to pump the fluidized sand and seawater mixture in sump enclosure 28 through the transport pipe 30a, to the remote discharge point 94 which would be located on the other side of a nearby ridge of sand dunes 110. Pump 96a can also supply fluidizing water to ring 32 and fluidizing pipe 31.

In view of the foregoing description, it can now be appreciated that the submerged fluidized sand induction and transport device of the present invention overcomes the problems of prior art attempts to maintain navigation channels and control the formation of sand bars by capturing in an enclosure the sand which is fluidized by the invention and directing that sand in a controlled flow to a desired, remote discharge point.

The inventive design of this device further yields the inherent advantage that virtually all components of the device are submerged in the sand bed and are therefore very well protected from wind, waves, tides, storms, hurricanes and typhoons which could quickly destroy an exposed sand bypass or collection system.

It can also now be appreciated that not only is the invention useful for the maintenance of navigation channels, but could also be used in a variety of ways to control the unwanted build up of sand, silt or the like.

It will therefore be readily appreciated by those skilled in the art that numerous variations and modifications may be made to the invention without departing from the spirit and scope thereof as set forth in the following claims.

I claim:

1. An apparatus for transporting sand or silt which underlies or adjoins a body of water, comprising:

an elongated enclosure completely buried below the top level of the sand or silt, said enclosure having a top, a pair of side walls, a pair of end walls, and an open bottom, said open bottom comprising a first opening, one of said end walls being at least partially open and including a second opening; and a means to fluidize sand or silt underlying said enclosure, said fluidizing means comprising at least one pipe having apertures or nozzles for discharging fluidizing media delivered to said pipe into the sand or silt surrounding said pipe to fluidize said sand or silt and to cause said fluidized sand or silt to move up into said enclosure through said first opening and out of said enclosure through said second opening.

2. The apparatus of claim 1, further comprising a means to remove sand or silt discharged from said enclosure through said second opening to a remote location.

3. The apparatus of claim 2 wherein said means for removing discharged sand or silt comprises a sump enclosure positioned adjacent to said second opening to receive within said sump enclosure sand or silt discharged through said second opening, and a pump means located within said sump enclosure to pump sand or silt discharged into said sump enclosure to a location away from said sump enclosure.

4. The apparatus of claim 3 wherein said pump means comprises a jet pump having a jet pump nozzle for discharging a high velocity pumping medium into a jet pump throat, with said jet pump throat being connected to a transport pipe for transporting sand or silt discharged into said sump enclosure to a remote location.

5. The apparatus of claim 4 wherein said jet pump includes a jet pump fluidizing means to fluidize sand or silt discharged into said sump enclosure in the vicinity of said jet pump throat.

6. The apparatus of claim 1 wherein said at least one pipe comprises at least two pipes, one of said pipes being positioned under each of said side walls, a fluidizing medium being supplied to said pipes, said pipes having apertures or nozzles for discharging said fluidizing medium into the sand or silt surrounding said pipes to fluidize said sand or silt.

7. The apparatus of claim 1 further comprising a header pipe extending along the top of said enclosure, said header pipe being connected to a source of fluidizing medium, with one or more bypass pipes having first and second ends connected at said first end to said header pipe, and wherein said at least one pipe extends along the bottom of said enclosure, said one or more bypass pipes connected at said second end to said at least one pipe, wherein said fluidizing medium flows from said header pipe through said one or more bypass pipes into said at least one pipe and is discharged through said apertures or nozzles into the sand or silt surrounding said at least one pipe to fluidize said sand or silt.

8. A method of fluidizing and transporting sand or silt underlying or adjoining a body of water, comprising the steps of:

burying an elongated enclosure having first and second openings completely below the top surface of said sand or silt;

supplying a pressurized fluidizing medium to at least one pipe positioned below said enclosure; and discharging said fluidizing medium from said pipe into the sand or silt surrounding said pipe through apertures or nozzles provided on said pipe to fluidize the sand or silt below said enclosure to cause said fluidized sand or silt to move up into said enclosure through said first opening and out of said enclosure through said second opening.

9. The method of claim 8 further comprising the step of transporting the sand or silt discharged from said second opening of said enclosure to a discharge location.

10. The method of claim 9 wherein the sand or silt discharged from said second opening is discharged into a sump enclosure, and wherein a pump is located in said sump enclosure, and a transport pipe is connected at one end to said pump, said pump transporting the sand or silt in said sump through said transport pipe to deliver said sand or silt to said discharge location at the other end of said transport pipe.

11. The method of claim 10 further comprising the step of fluidizing the sand or silt in the vicinity of said pump.

12. A submerged fluid induction device for transportation of sand or silt underlying or adjoining a body of water, comprising an elongated enclosure having solid top and side walls, at least one partially open end and another end being closed by an end wall, and an open bottom, and at least one apertured fluidizing pipe disposed below said open bottom of said enclosure, said fluid induction device being completely buried in said sand or silt in a substantially horizontal orientation with respect to said body of water so that said solid top is located below the top surface of said sand or silt, the arrangement being such that, when water is impelled through said at least one fluidizing pipe and discharged through said apertures therein, said sand or silt is induced into said enclosure through said open bottom in fluidized form for discharge from said partially open end.

13. The fluid induction device as claimed in claim 12, further including means for removing, to a remote location, sand or silt discharged from said at least partially open end.

14. The fluid induction device as claimed in claim 13 wherein said at least one fluidizing pipe below said enclosure can be used to install said enclosure in a sand bed by fluidizing the sand below said enclosure to allow said enclosure to descend through said sand bed to a desired position whereat said enclosure can be fixed in position to suitable supports, and where said means for removing sand or silt to a remote location also includes fluidizing means positioned below said removing means to allow said removing means to descend through said sand bed to a desired position, with said removing means being securable to said enclosure.

15. The fluid induction device as claimed in claim 12, wherein said enclosure is laid with a small, positive pressure gradient to aid movement of fluidized sand or silt therethrough.

16. The fluid induction device as claimed in claim 12, wherein an inlet is provided, adjacent the top of the upstream end of said enclosure for ingress of pressurised fluid.

17. The fluid induction device as claimed in claim 16 wherein said apertures in said at least one fluidizing pipe are directed downwardly, upwardly or sideways.

* * * * *